US010228145B2

(12) United States Patent
Erbe et al.

(10) Patent No.: US 10,228,145 B2
(45) Date of Patent: Mar. 12, 2019

(54) COOKING DEVICE WITH LIGHT PATTERN PROJECTOR AND CAMERA

(71) Applicant: BSH Hausgeräte GmbH, Munich (DE)

(72) Inventors: Sebastian Erbe, Palling (DE); Robert Kühn, Palling (DE); Dan Neumayer, Bernau (DE); Daniel Vollmar, Karlsruhe (DE)

(73) Assignee: BSH Hausgeräte GmbH, Munich (DE)

( * ) Notice: Subject to any disclaimer, the term of this patent is extended or adjusted under 35 U.S.C. 154(b) by 0 days.

(21) Appl. No.: 15/315,791

(22) PCT Filed: Jun. 3, 2015

(86) PCT No.: PCT/EP2015/062349
§ 371 (c)(1),
(2) Date: Dec. 2, 2016

(87) PCT Pub. No.: WO2015/185608
PCT Pub. Date: Dec. 10, 2015

(65) Prior Publication Data

US 2017/0115008 A1 Apr. 27, 2017

(30) Foreign Application Priority Data

Jun. 5, 2014 (DE) ..... 10 2014 210 672

(51) Int. Cl.
*G01B 11/00* (2006.01)
*G01B 11/30* (2006.01)
(Continued)

(52) U.S. Cl.
CPC ..... *F24C 7/081* (2013.01); *F24C 7/085* (2013.01)

(58) Field of Classification Search
CPC ..... F24C 7/081; F24C 7/085; H05B 6/6455; H05B 6/68; H05B 6/80; G01B 11/00; F27B 5/10; F27B 5/00; A21B 1/00
(Continued)

(56) References Cited

U.S. PATENT DOCUMENTS 4,224,743 A * 9/1980 Erickson ..... F26B 9/00 126/21 A
4,588,297 A 5/1986 Inazaki et al.
(Continued)

FOREIGN PATENT DOCUMENTS

CN 101008500 A 8/2007
DE 19748062 A1 5/1999
(Continued)

OTHER PUBLICATIONS

International Searach Report PCT/EP2015/062349 dated Aug. 12, 2015.
National Search Report DE 10 2014 210 672.9 dated Aug. 16, 2015.

*Primary Examiner* — Michael G Hoang
(74) *Attorney, Agent, or Firm* — Michael E. Tschupp; Andre Pallapies; Brandon G. Braun

(57) ABSTRACT

A cooking appliance includes a cooking chamber having a loading opening which is closable by a door. A light pattern projector is arranged in a fixed manner relative to the cooking chamber and configured to generate and radiate a light pattern into the cooking chamber. A camera captures images from a region being irradiated by the light pattern projector when the cooking chamber is closed, and is arranged in a fixed manner relative to the cooking chamber, Coupled to the camera is an analysis facility which repeatedly calculates a three-dimensional shape by light pattern analysis of an object located in the region being irradiated by the light pattern projector during operation of the cooking appliance.

35 Claims, 4 Drawing Sheets

(51) Int. Cl.

| | |
|---|---|
| ***G01B 11/24*** | (2006.01) |
| ***A21B 1/00*** | (2006.01) |
| ***F24C 7/08*** | (2006.01) |

(58) Field of Classification Search
USPC ..... 219/392, 411, 413; 392/416; 373/109
See application file for complete search history.

(56) References Cited

U.S. PATENT DOCUMENTS

| | | | | |
|---|---|---|---|---|
| 9,074,870 | B2 | 7/2015 | Marzok et al. | |
| 9,206,988 | B2 * | 12/2015 | Wiedenmann | F24C 15/008 |
| 2002/0005892 | A1 | 1/2002 | Herre | |
| 2005/0000367 | A1 * | 1/2005 | Meade | B65G 23/44 99/360 |
| 2010/0128755 | A1 | 5/2010 | Luckhardt et al. | |
| 2011/0002677 | A1 * | 1/2011 | Cochran | H05B 3/0057 392/416 |
| 2012/0132636 | A1 | 5/2012 | Moore | |
| 2015/0086939 | A1 * | 3/2015 | Fisker | A61C 9/0053 433/29 |

FOREIGN PATENT DOCUMENTS

| | | | |
|---|---|---|---|
| DE | 102006005874 | A1 | 11/2006 |
| EP | 2149755 | A1 | 2/2010 |
| EP | 2530387 | A1 | 12/2012 |
| JP | 2001099615 | A | 4/2001 |
| TW | 200427953 | A | 12/2004 |
| WO | 0070303 | | 11/2000 |
| WO | 2010102261 | A1 | 9/2010 |
| WO | 2013098004 | A1 | 7/2013 |

* cited by examiner

COOKING DEVICE WITH LIGHT PATTERN PROJECTOR AND CAMERA

CROSS-REFERENCES TO RELATED APPLICATIONS

This application is the U.S. National Stage of International Application No. PCT/EP2015/062349, filed Jun. 5, 2015, which designated the United States and has been published as International Publication No. WO 2015/185608 A1 and which claims the priority of German Patent Application, Serial No. 10 2014 210 672.9, filed Jun. 5, 2014, pursuant to 35 U.S.C. 119(a)-(d).

BACKGROUND OF THE INVENTION

The invention relates to a cooking appliance, having a cooking chamber with a loading opening which can be closed by means of a door, a light pattern projector which is arranged in a fixed manner relative to the cooking chamber for generating a light pattern, a camera for capturing images from a region which can be irradiated by the light pattern and an analysis facility which is coupled to the camera for calculating a three-dimensional shape of at least one object, which is located in the region that can be irradiated by the light pattern, by means of a light pattern analysis. The invention is particularly advantageously applicable to ovens. The invention is particularly advantageously applicable to household appliances.

EP 2 530 387 A1 discloses an oven with an apparatus for detecting a three-dimensional shape of foodstuff on a baking sheet in the oven. The apparatus contains at least one laser which is arranged or can be arranged above a cooking chamber of the oven. A laser beam from the laser is directed downward. The apparatus also comprises at least one camera, which is arranged or can be arranged above a baking sheet in the oven. The camera is arranged or can be arranged in a front segment of the oven. The baking sheet and camera are coupled mechanically so that the camera and baking sheet can be moved synchronously. An upper face of the baking sheet is located in a field of view of the camera. An angle between a center axis of a field of view of the camera and of the laser beam is predefined. Also disclosed is the apparatus for detecting the three-dimensional shape of the foodstuff on the baking sheet.

EP 2 149 755 A1 discloses an oven for heating food products, comprising a cooking chamber for receiving the product by way of a loading opening, and a product feature extraction system which is designed to extract at least one product feature which is representative of a configuration of the product, the system comprising: at least one camera, which is configured and arranged to capture top views of the product, and at least one contour plane unit, for extracting or highlighting contour planes of at least one segment of the product, and, as the case may be, an object provided to be introduced into the cooking chamber with the product, and a product feature extraction unit for extracting the at least one product feature based on the top view of the product and contour planes of the product.

A method serves to operate an oven for heating a food product, comprising the following steps: a) extracting a product feature of a product to be heated in a chamber of the oven, by capturing at least one top view of a product using at least one camera, extracting and/or highlighting contour planes of at least one segment of the product, and, as the case may be, an object intended to be introduced into the cooking chamber with the product, using at least one contour plane unit, and b) extracting the at least one product feature based on the top views and contour planes, based on at least one product feature and optionally secondary data representing a physical configuration of the product, preferably at least one of product temperature, product weight and product density, for the purposes of automatic control or to heat the product.

EP 1 921 384 A1 discloses an apparatus for determining the temperature in the interior of food. The apparatus has at least one temperature sensor for detecting at least one surface temperature of the food and/or an ambient temperature of the food, in particular at a measurement site within a cooking chamber enclosing the food, preferably using an ambient temperature sensor arranged at the measurement site. The apparatus also comprises at least one distance sensor for detecting one or a plurality of distances between the distance sensor on the one hand and one or a plurality of distance measurement points on the surface of the food. The apparatus also comprises at least one time measurement facility for detecting the time as the food cooks and at least one calculation facility for calculating the temperature in the interior of the food from the surface temperature of the food and/or ambient temperature, the distance or the plurality of distances, time and an initial temperature of the food. Also disclosed is a method for determining the temperature in the interior of food.

DE 197 48 062 A1 discloses a method and facility for the three-dimensional optical scanning of objects. According to this with optical three-dimensional measurement methods operating over a surface the measurement system must be calibrated, as the geometric characteristics of the system must be known to perform the triangulation calculation. After calibration the lenses cannot be moved as this would change the mapping errors of the optical systems in a manner that could not be monitored. The method allows the measurement system to be set for a different measurement field size even after calibration. By determining the inner beam bundles of the projector and camera using a facility which serves at the same time to focus on different measurement distances, the measurement system is adjusted for different measurement field sizes in such a manner that the geometric changes made to the system in the process can be determined precisely and the parameters required for triangulation can be calculated without recalibration. Calibration takes place for a measurement field size selected solely from the point of view of favorable calibration apparatus production and easily manageable dimensions. The system, once calibrated, can then be set for a wide range of, in particular even very large, measurement distances and volumes. Application to household appliances or cooking appliances is not disclosed.

WO 00/70303 discloses a method and apparatus for imaging three-dimensional objects, comprising a structured light source, which projects a focused image onto an object, with light passing either continuously or stroboscopically through an optical grid and a downstream projection lens. Application to household appliances or cooking appliances is not disclosed.

DE 10 2006 005 874 A1 discloses an apparatus and method for contactless scanning of in particular cylindrical objects on surfaces. To this end it is proposed that a laser be used to generate a line on the surface, the reflection of which is measured by a camera. Once the line has been recorded, it is displaced multiple times parallel to itself and the recording is repeated. Successive line displacement produces a shadow image of the object arranged on the surface. It is also possible to separate the multiple line triangulation and shadow imaging from one another. A fixed laser or a different radiation source can be used for the multiple line triangulation. Shadow imaging can be performed by two similarly fixed beam sources, for example a series of LEDs, simultaneously or one after the other. The use of a fixed structure of radiation sources and camera simplifies and reduces the price of the mechanical structure. Application to household appliances or cooking appliances is not disclosed.

BRIEF SUMMARY OF THE INVENTION

It is the object of the present invention to overcome at least some of the disadvantages of the prior art and specifically to provide a way of scanning food that can be implemented in a particularly versatile manner.

This object is achieved according to the features of the independent claims. Preferred embodiments will emerge in particular from the dependent claims.

The object is achieved by a cooking appliance, having a cooking chamber with a loading opening which can be closed by means of a door, (at least) one projector (referred to in the following without restricting its general nature as a "light pattern projector") which is arranged in a fixed manner relative to the cooking chamber for generating a light pattern, (at least) one camera for capturing images from a region which can be irradiated by the light pattern and an analysis facility which is coupled to the camera for calculating a three-dimensional shape of at least one object, which is located in the region that can be irradiated by the light pattern, by means of a light pattern analysis, the light pattern projector being arranged to radiate a light pattern into the cooking chamber, the camera being arranged in a fixed manner relative to the cooking chamber, the camera being arranged to capture images from a region of the cooking chamber which can be irradiated by the light pattern even when the cooking chamber is closed and the analysis facility being designed to calculate repeatedly the three-dimensional shape of the at least one object, which is located in the region of the cooking chamber which can be irradiated by the light pattern, during operation of the cooking appliance.

The cooking appliance has the advantage that the depth information can serve as a parameter for automatic programs. It can be used to detect any change in the volume of the food during the cooking process during operation of the cooking appliance and can influence control of the cooking parameters, e.g. a cooking chamber temperature. For example the rising behavior of a loaf and the shrinking behavior of a piece of meat can be detected and can optionally be used to control the cooking appliance.

The method, which is known in principle, of patterned or structured light (structure light) in particular is therefore applied to generate the three-dimensional shape or three-dimensional image of the region of the cooking chamber that can be irradiated by the light pattern. A defined light pattern is projected by means of the light pattern projector onto the object to be captured or measured, before being captured by the camera. The degree of deformation of the light pattern at the object allows the analysis facility to calculate a three-dimensional model of said object. Depth resolution of a defined image point here is a function of the angle between a light beam for generating said image point and a normal vector to a plane or to an optical axis of the camera. A theoretical resolution optimum would be present at a largest possible angle. However visibility of the projected light pattern on the object surface and therefore its detectability by the camera deteriorates as this optimum is approached. Position determination is only possible for those points that are on the one hand visible from the camera and on the other hand can be irradiated by the light pattern projector (in other words are not in shadow).

The cooking appliance may be an oven or may comprise such, in particular a baking oven. The cooking chamber may then also be referred to as the oven chamber. The oven may be an independent oven or part of a combined oven/cooktop appliance or a cooker. Additionally or alternatively to an embodiment as an oven, the oven may have microwave and/or steam treatment functionality.

In one development the cooking appliance is a household appliance, in particular in the sense of "white goods".

The light pattern projector together with the camera and the analysis facility may also be referred to as a 3D scanner. The light pattern projector emits at least one light pattern, e.g. a pattern of lines and/or dots but is not restricted thereto. Other light patterns of choice may also be generated, for example ring-type patterns, wave patterns, etc. A pattern is in particular selected so that it is appropriate for the desired resolution of the three-dimensional image.

The camera may in particular be a digital camera. It may capture individual images and/or image sequences, in particular videos.

The analysis facility may be an independent facility of the cooking appliance, e.g. in the form of an electronic unit, in particular on its own printed circuit board. It may alternatively be integrated in a further facility of the cooking appliance, e.g. in a central control facility. This further facility may then additionally be able to perform the analysis in particular.

In one embodiment an optical axis of the light pattern projector and an optical axis of the camera are at an angle of between 20° and 30° to one another. This allows good visibility of the projected light pattern to be achieved with good depth resolution and therefore particularly reliable determination of the three-dimensional shape of the at least one object.

In a further embodiment the light pattern projector and camera are arranged behind a wall or muffle of the cooking chamber, in particular at a predefined distance. This allows these two components to be thermally insulated to a sufficient degree from the cooking chamber. The cooking chamber wall may have a window for the light pattern projector and camera respectively. The window may be covered with transparent glass.

In a further embodiment the light pattern projector and camera are arranged behind a ceiling of the cooking chamber. This allows a food support (e.g. a baking sheet or rack) to be fully illuminated and captured particularly easily. This in turn allows particularly precise images and measurements to be generated. This position has the further advantage that cooling air (e.g. for cooling electronic units arranged above the cooking chamber) conducted across the ceiling can also be used to cool the light pattern projector and camera. The distance at which the light pattern projector and camera are located behind the cooking chamber wall or muffle can be muffle-specific.

In a further embodiment the light pattern projector can radiate different light patterns into the cooking chamber. This allows the three-dimensional shape of the at least one object to be determined with particularly little error. For example alternating dot and line-type light patterns can be radiated in and analyzed. Different dot patterns and/or different line patterns can also be radiated into the cooking chamber. This can be done in a predefined sequence or if a measured depth resolution provides inadequate results.

In a further embodiment the light pattern projector has at least one image point-type shield or screen for shaping the light pattern. It allows the light pattern to be configured and varied particularly easily with high resolution. The image point-type screen may be for example a liquid crystal screen or an LCD screen. The image point-type screen may operate as a structural unit to generate light itself in order to irradiate the cooking chamber adequately with the light pattern. However the image point-type screen may also be backlit by at least one separate light source so that it can be used as a "variable aperture". The latter allows particularly large light flows.

The light emitted by the light pattern projector and received by the camera may be visible light and/or infrared light. The advantage of infrared light is that an observer looking into the cooking chamber does not see the light pattern.

In one development the 3D scanner can be calibrated. In one embodiment of this there is at least one calibration marking in the muffle. The known position of the at least one calibration marking relative to the at least one object to be measured can be used to determine a distance to the object and therefore also its size or shape more precisely.

In an alternative or additional embodiment at least one calibration marking is present on a food support, e.g. a baking sheet or rack, etc. It may be present in particular on an area of the food support taken up by or in contact with the food. This calibration marking may in particular be of known size, so that a distance from the camera can be determined based on the size captured by the camera.

A calibration marking may be for example a colored marking and/or a marking of predefined shape. The calibration markings can also be defined geometric features, e.g. functional regions of the cooking chamber wall or muffle such as insertion guides. The calibration marking(s) can also serve to determine the insertion level at which the object to be measured is located.

Calibration preferably takes place in the closed muffle or with the cooking chamber closed, in particular at the start of a cooking operation. This minimizes any ambient influence on the measurement. To simplify reliable detection of the food and prior calibration, it is advantageous to predefine preferred insertion levels in the cooking chamber for the 3D scan. These are preferably in a lower third of the muffle. This has the advantage that objects with a large surface and/or large volume can be recognized and scanned reliably.

The 3D scan of the object advantageously takes place after calibration. However in principle calibration may also be omitted.

In one development the cooking appliance is equipped with insertion recognition. Then, if the cooking appliance recognizes that a food support is at an insertion level that is not favorable for a 3D scan, it can output a notification signal and/or display for a user. The cooking appliance may then also prevent 3D scanning.

In a further embodiment the analysis facility is designed to recognize a type of food. This allows, inter alia, an automatic adjustment of cooking parameters for the food (e.g. as part of a cooking program) and/or the adjustment of a user guide for the food (e.g. by displaying cooking parameters and/or cooking programs that are suitable for the recognized food).

In one development the cooking appliance is designed to perform food recognition based on an image analysis of images captured by the camera (without 3D scanning, also referred to in the following as image recognition). Food recognition based on the 3D scan can take place additionally or alternatively. Food recognition based on combined image recognition and 3D scanning allows greater probability of recognition due to the additional height and depth information. This may be included for example as input into an image recognition algorithm.

In another embodiment the analysis facility is designed to recognize a type of food support, e.g. whether the food is on a rack or baking sheet. The cooking appliance can use such information for example to set or adjust cooking parameters, for example the heat output of an upper and/or lower heating unit or activation and/or setting of a heat output of a circulating air heating unit.

In one development the analysis facility is designed to recognize a type of equipment, in particular cookware, for example a roasting tin or the like holding the food on a food support. It may be possible to measure whether the food is in an open roasting tin or whether the roasting tin is closed. The cooking appliance may also use such information to set or adjust cooking parameters and optionally also to select the cooking method used. If the roasting tin is closed, the cooking appliance may require user input relating to the nature of the contents.

In another embodiment the analysis facility is designed to recognize a core temperature of an object. The core temperature can be calculated by correlation with a volume change as determined by the 3D scan during a cooking process with knowledge of the type of food. There may therefore be no need for a separate core temperature sensor or food thermometer. In one preferred development for a particularly high level of reliability when determining core temperature the food has an almost homogeneous structure. In the present instance therefore the core temperature is determined by means of a 3D scan, not by means of one or more distance sensors as described in EP 1 921 384 A1.

In one embodiment the analysis facility is coupled to a control facility of the cooking appliance and the control facility is designed to adjust operation of the cooking appliance based on at least one object parameter determined by the analysis facility. As discussed to some degree above, the associated object can be food, equipment and/or a food support. Object parameters can be for example the position, shape, volume or type, etc. of the object. In principle the 3D information determined by one or more 3D scans can be used in particular to automate cooking, roasting and baking processes. As mentioned above, it is also possible to perform the 3D scan during a cooking operation. The 3D information or 3D data thus determined can be used not only for food recognition but also for any adjustment of the cooking parameters. A cooking operation or cooking process can thus be tailored individually to the food. Should precise detection of the food not be possible, input from a user in particular can be taken into account. To this end the cooking appliance may ask the user to input further information relating to the food into the cooking appliance.

In yet another embodiment the cooking appliance has a screen, on which at least one three-dimensional image of at least one object captured by the camera can be displayed. In other words a three-dimensional display of the contents of the cooking chamber is presented on a screen. This allows particularly informative information to be displayed for a user. The screen may be present for example on a front face or top face of the cooking appliance. The screen may be a touch-sensitive sensor screen or touchscreen.

One option for operating the cooking appliance is to perform a calibration before the start of a food treatment (e.g. a cooking process). Also a 3D scan of the food may be performed shortly before the start of a food treatment to detect its initial geometry. Object recognition may also be performed before the start of a food treatment, relating to the type of food, the type of equipment and/or the type of food support.

In order to be able to determine a change in the shape of the food, at least one 3D scan may also take place during food treatment, in particular a number of 3D scans at for example periodic intervals. Food recognition, recognition of the end of treatment and/or determination of a core temperature for example may be performed by means of the recognized change in the shape of the food.

In a further embodiment the light pattern projector is also provided to illuminate the cooking chamber. It may for example illuminate the cooking chamber so that a user can see inside it, only radiating the light pattern into the cooking chamber for relatively short periods in between. There is then no need for a separate light source to illuminate the cooking chamber.

BRIEF DESCRIPTION OF THE DRAWINGS

The attributes, features and advantages of this invention as described above as well as the manner in which these are achieved will become clearer and more comprehensible in conjunction with the following schematic description of an exemplary embodiment, which is explained in more detail in conjunction with the drawings.

DETAILED DESCRIPTION OF EXEMPLARY EMBODIMENTS OF THE PRESENT INVENTION

Figure 1:
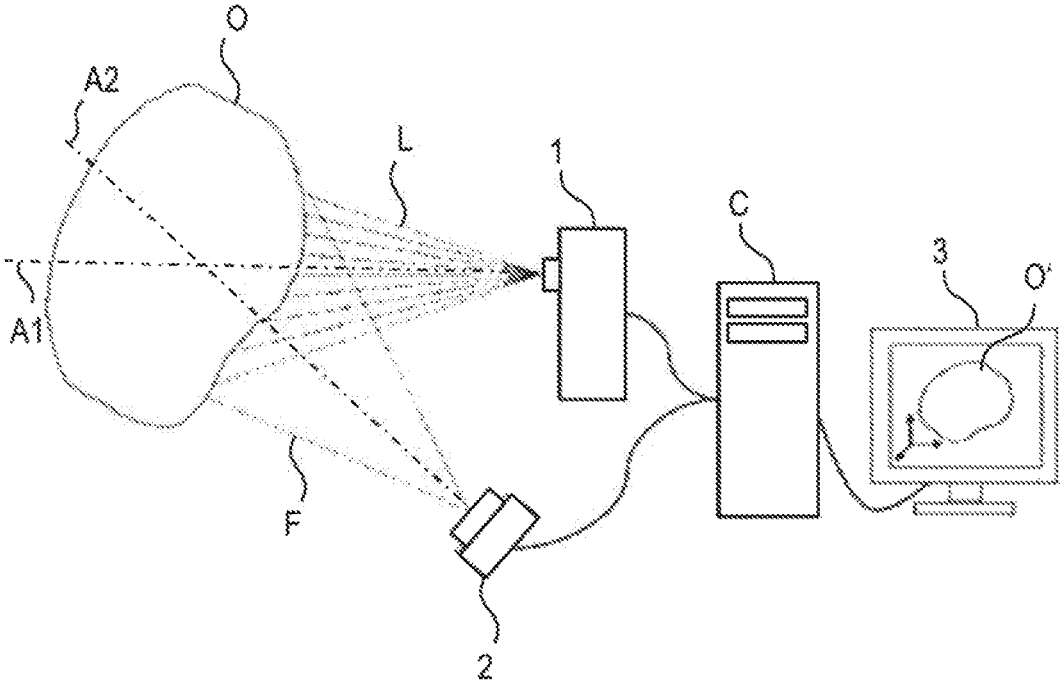
FIG. 1 shows an outline of an arrangement of a 3D scanner.

FIG. 1 shows an arrangement (3D scanner) for determining a three-dimensional shape of at least one object O (3D scanner), having a light pattern projector 1 directed onto the object, a camera 2 directed onto the object O, a control facility C for operating the light pattern projector 1 and for calculating a three-dimensional shape of the object O based on at least one image received by the camera 2 by means of a light pattern analysis. A screen 3 is optionally present for observing the object O' calculated by the control facility C.

The light pattern projector 1 generates a predetermined light pattern L, e.g. a line or dot pattern. The light pattern projector 1 radiates its light in a light bundle with a first optical axis A1.

The camera 2, typically a digital camera, has a field of view F with a second optical axis A2, which is aligned obliquely in relation to the first optical axis A1 of the light pattern projector 1. In other words the camera 2 is aligned obliquely in relation to the light pattern projector 1. It views a region of the object O that is or can be irradiated by the light pattern L.

Figure 2:
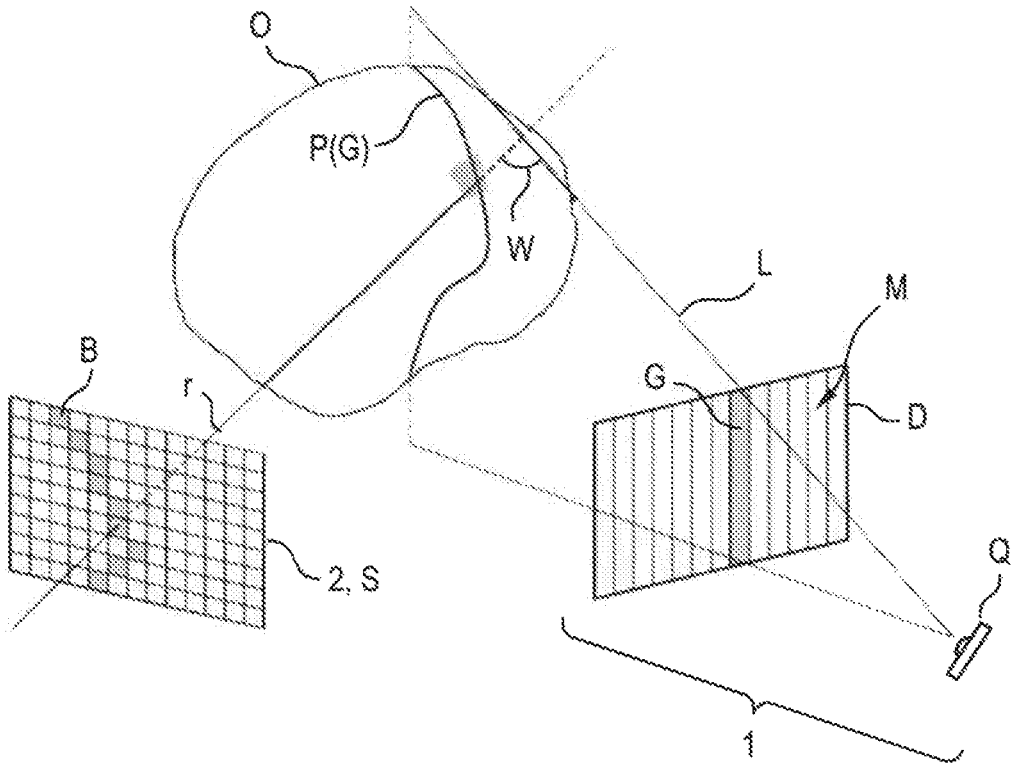
FIG. 2 shows an outline of a reconstruction of a shape of an object scanned using a 3D scanner.

FIG. 2 shows an outline of a reconstruction of a shape of the object O scanned using the 3D scanner 1, 2, C.

The light pattern projector 1 here has a light source Q, e.g. a field of light emitting diodes, downstream of which is a pattern generation element in the form of a permeable, freely programmable LCD surface D. Depending on the pattern M generated on the LCD surface D, a corresponding, in particular complementary, light pattern L is emitted from the LCD surface D. Alternatively an LED screen may serve as the light source (not shown), with the backlighting integrated therein then dispensing with the need for a separate light source.

FIG. 2 shows an example of how light is radiated in the form of a vertical column or line G from the light pattern projector 1 onto the object O. A projection P(G) of this line G, distorted by the surface contour of the object O, therefore appears on the object O. Because of its oblique position in relation to the light pattern projector 1, the camera 2 captures an image of this projection P(G) which shows the distortion. The camera 2 stores the projection P(G) as correspondingly positioned image points B or pixels of a matrix, which results from a matrix-type arrangement of individual sensors in a sensor array S of the camera, e.g. a CCD sensor array. The height or depth information is defined by the deviation of the image points B from a vertical line.

If the planes of all vertical columns or lines G are known and a light beam r in the space, from which the light striking the respective individual sensor originates, can be assigned to each image point B in the camera image, and if there is also an assignment of the image points to the projection P(G) visible from the image points and therefore also to the corresponding lines G, points on the object surface can be reconstructed by means of a simple beam plane section.

Depth resolution here is a function of an angle W between the light beam r leading to the image point B and the direction of the column or line G. A theoretical resolution optimum would be present at a greatest possible angle W. However visibility of the projection P(G) on the surface of the object O and therefore its detectability in the camera image deteriorates as this optimum is approached. As reconstruction is only possible for those points on the surface of the object O which on the one hand are visible from the camera 2 and on the other hand can be irradiated by the light pattern projector 1, a compromise is reached here. Such a 3D scan is known in principle and is therefore not explained further in the following.

Figure 3:
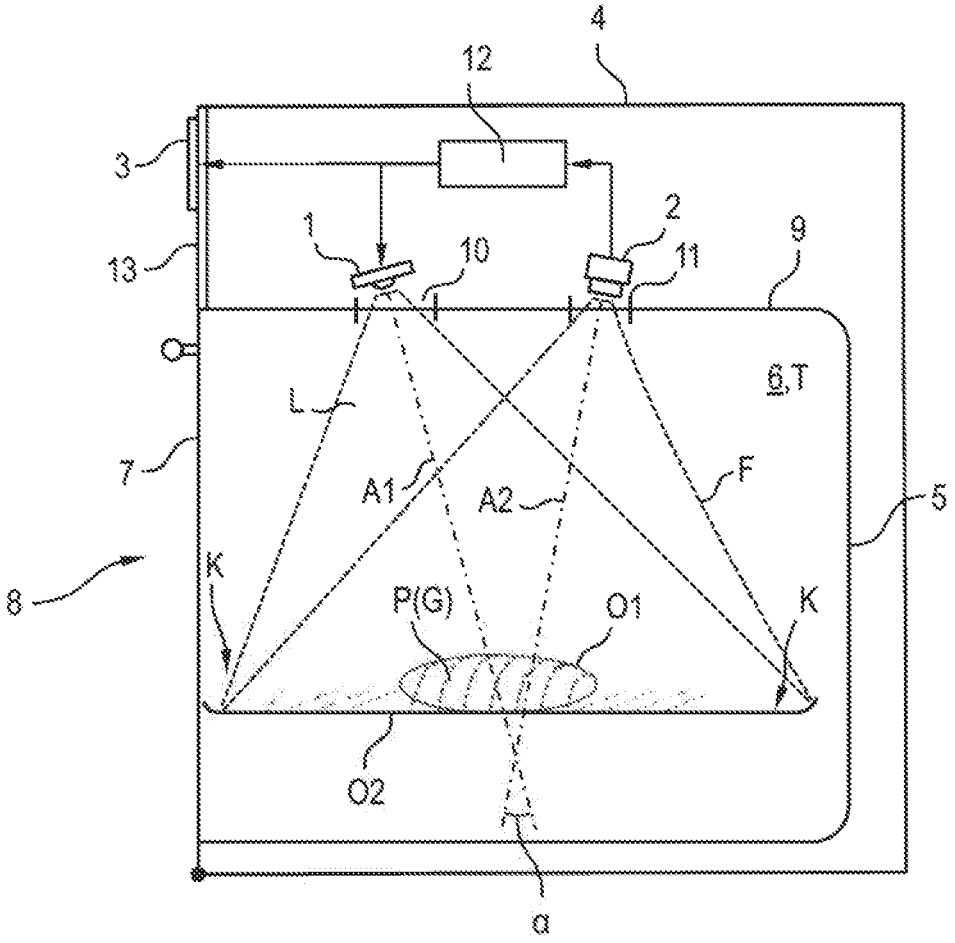
FIG. 3 shows a sectional diagram of a side view of an inventive cooking appliance equipped with a 3D scanner.

FIG. 3 shows a sectional diagram of a side view of a cooking appliance equipped with a 3D scanner, in the form of an oven 4. The oven 4 has a cooking chamber 6 delimited by an oven muffle 5. At its front the oven muffle 5 has a loading opening 8 which can be closed by means of an oven door 7, through which loading opening 7 objects, in particular in the form of food O1, can be moved into the cooking chamber 6. A cooking chamber temperature T can be set by means of one or more, in particular electrically operated, heating units (not shown).

On a ceiling 9 of the oven muffle 5 are two viewing windows 10 and 11, which can be covered with transparent glass panes for example. On the side of the oven muffle 5 facing away from the cooking chamber 6 and at a predefined distance from the oven muffle 5, behind the viewing window 10, is a light pattern projector 1 (e.g. with an LCD display for pattern generation) and behind the viewing window 11 is a camera 2. These are protected thermally by their distance from the oven muffle 5. A cooling air flow may also flow across the ceiling 9, e.g. to cool components arranged there, such as a control facility. The light pattern projector 1 and the camera 2 can also be further cooled by said cooling air flow.

The light pattern projector 1 and the camera 2 are arranged with a lateral offset from one another. Their optical axis A1 and A2 also form an angle $\alpha$ of between 20° and 30°, which allows high depth resolution with good visibility. The light pattern projector 1 and the camera 2 are arranged in a fixed manner relative to the cooking chamber 6 and therefore do not move when the oven door 7 is actuated.

The light pattern projector 1 radiates a light pattern L through the viewing window 10 into the cooking chamber 6 so that practically the entire horizontal surface of the cooking chamber 6 can be illuminated with the light pattern L from a predefined distance from the ceiling 9. This may be the case for example in a lower half or in a lower third of the cooking chamber 6. The camera 2 captures images from a region of the cooking chamber 6 which can be irradiated at least partially by the light pattern.

The oven 4 also has an analysis facility 12 which is coupled to the camera 2 for calculating a three-dimensional shape for example of the food O1 and a food support O2, which are in the region that can be irradiated by the light pattern L, by means of a light pattern analysis. This is based on a 3D scan based on at least one image captured by the camera 2. The light pattern projector 1, the camera 2 and the analysis facility 12 together form the 3D scanner. As shown here, the analysis facility 12 may be integrated functionally in a central control facility of the oven 4 or may be coupled to a control facility as an independent unit.

A 3D scan, comprising for example a capturing of an image of the projection P(G) of the light pattern L by means of the camera 2 and from this a calculation of the three-dimensional shape of the food O1 and the food support O2, can be performed with the oven door 7 or loading opening 8 closed.

In particular a calibration can be performed first with the oven door 7 closed but before the cooking process has started. To this end the food support O2 has one or more, for example colored, calibration markings K on its upper face, which are of known size and can be easily identified. For example it is possible to identify a distance from the ceiling 9 and therefore for example the insertion level used from the size of the calibrations marking(s) K captured by the camera 2. If the insertion level is unsuitable for the 3D scan, because it is too high for example, the oven 4 may output a notification to a user, e.g. a display on a front screen 3 on an operating panel 13. At least one calibration marking may also be present on the oven muffle 4.

After the calibration but before a cooking process or treatment of the food O1, an initial 3D scan of the food O1 may be performed by means of the 3D scanner 1, 2, 12, in order to calculate its original shape. The calculated shape may be displayed on the screen 3. The calculated shape may be used by the cooking appliance 4 to determine the food O1, in particular in addition to image recognition of the food O1 that can also be performed by the camera 2. A type of food support O2 may also be recognized using the 3D scanner 1, 2, 12. One or more cooking parameters of the cooking process may be adjusted based on recognition of the food O1 and optionally of the food support O2. A cooking time and/or the cooking chamber temperature T may therefore be adjusted based on the recognized type and/or volume of the food and/or the recognized food support O2.

During the cooking process 3D scans can be performed repeatedly to determine a change in the shape and/or volume of the food O1. In the event of a change in the shape and/or volume the oven 4 may adjust the cooking process, e.g. change the cooking time and/or the cooking temperature, including switching off the heating units.

In order to improve the accuracy of the depth information and therefore of the volume of the food O1, the light pattern projector 1 may radiate different light patterns L into the cooking chamber 6.

Figure 4:
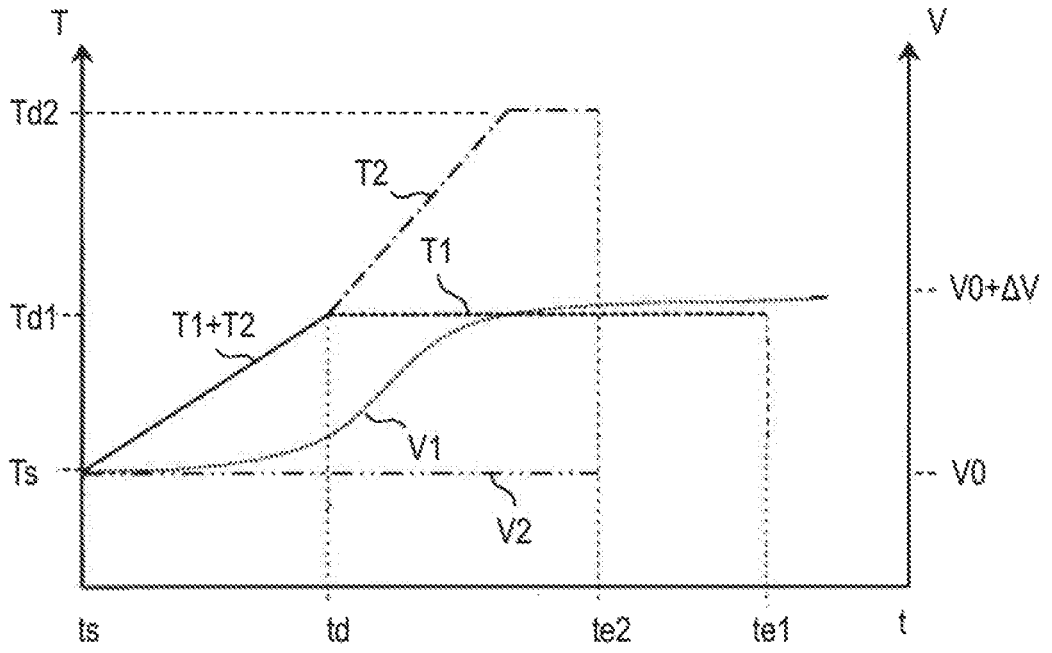
FIG. 4 shows a diagram of a temperature and volume profile of a heated object with food determination by means of an inventive cooking appliance.

FIG. 4 shows a diagram of a profile of a temperature T and a volume V of the food O1 with a food determination by means of the cooking appliance 4 for example.

Purely by way of example, the food O1 is a baked product, for example a round pizza or a sponge cake in a springform pan. Image recognition by the camera 2 alone cannot distinguish between these two types of food O1, as in a two-dimensional view from above (top view) both the pizza and sponge cake look circular. Both are also similar in color. However both types of food require a different and specific baking environment. If the pizza were treated in the same way as the sponge cake, the result would be unsatisfactory and vice versa. The 3D scan by means of the 3D scanner 1, 2, 12 additionally provides the cooking appliance 4 with spatial information about the food O1. This spatial information relating to the initial state of the food O1 before the cooking process (e.g. an initial volume V0) may already be enough to distinguish the flat pizza from the taller sponge cake. Additionally or alternatively the type of food O1 may also be determined from the change in its shape, in particular a change ΔV in its volume V, by means of the 3D scanner 1, 2, 12.

Thus at an initial time point ts of the cooking process the cooking chamber temperature T has an initial value Ts, e.g. room temperature. As time t progresses, the cooking temperature T increases due to at least one activated heating unit, in the same manner for pizza and sponge cake, as shown by the curve T1+T2. When the cooking chamber temperature T reaches a target temperature Td1 for sponge cake, which is below a target temperature Td2 for pizza, at a time point td, a further 3D scan is performed to determine the type of food O1.

If the height or volume V0 of the food O1 has not changed significantly, it can be assumed that it is pizza, which typically does not rise. Its volume profile is shown as the curve V2. Therefore if pizza is recognized, the cooking appliance 4 can then increase its cooking chamber temperature T for example to the associated target value Td2, as shown by the temperature curve T2. The cooking process ends at an associated end time point te2.

However if the height or volume V0 of the food O1 has increased noticeably by ΔV by time point td, it can be assumed that it is sponge cake, which typically rises. Its volume profile is shown as the curve V1. Therefore if sponge cake is recognized, the cooking appliance 4 may then keep its cooking chamber temperature T at the associated target value Td1, as shown by the temperature curve T1. The cooking process ends at an associated end time point te1.

The height and/or volume information from the 3D scan can therefore be used to provide a clear distinguishing feature for food recognition.

The present invention is of course not restricted to the exemplary embodiment shown.

Generally "one" can refer to one or a number, in particular in the sense of "at least one" or "one or more", unless this is specifically excluded, for example by the expression "just one", etc.

Also a figure can cover just the figure given as well as a standard tolerance range, unless this is specifically excluded.

The invention claimed is:

1. A cooking appliance, comprising:

a cooking chamber having a loading opening which is closable by a door;

a light pattern projector arranged in a fixed manner relative to the cooking chamber and configured to generate and radiate a light pattern into a region of the cooking chamber;

a camera for capturing images from the region being irradiated by the light pattern projector even when the cooking chamber is closed, said camera being arranged in a fixed manner relative to the cooking chamber;

an analysis facility coupled to the camera and configured to perform light pattern analysis of the light pattern irradiated into the region of the cooking chamber, the analysis facility configured to repeatedly calculate, based on the light pattern analysis of the light pattern, a three-dimensional shape of an object located in the region of the cooking chamber being irradiated by the light pattern projector during operation of the cooking appliance; and a muffle having predefined calibration markings in the muffle for delimiting the cooking chamber, wherein the analysis facility is configured to use the predefined calibration markings to perform a calibration.

2. The cooking appliance of claim 1, wherein an optical axis of the light pattern projector and an optical axis of the camera extend at an angle of between 20° and 30° to each other.

3. The cooking appliance of claim 1, further comprising a ceiling, said light pattern projector and said camera being arranged behind the ceiling of the cooking chamber.

4. The cooking appliance of claim 1, wherein the light pattern projector is configured to radiate different light patterns into the cooking chamber.

5. The cooking appliance of claim 1, wherein the light pattern projector includes at least one image point-type screen for shaping the light pattern.

6. The cooking appliance of claim 1, wherein the analysis facility is configured to recognize a type of food.

7. The cooking appliance of claim 1, wherein the analysis facility is configured to recognize a type of food support.

8. The cooking appliance of claim 1, wherein the analysis facility is configured to recognize a core temperature of the object.

9. The cooking appliance of claim 1, further comprising a control facility coupled to the analysis facility and configured to adjust operation of the cooking appliance based on at least one object parameter determined by the analysis facility.

10. The cooking appliance of claim 1, further comprising a screen configured to display at least one three-dimensional image of the object captured by the camera.

11. The cooking appliance of claim 1, wherein the light pattern projector is configured to illuminate the cooking chamber.

12. The cooking appliance of claim 1, wherein the analysis facility calculates the three-dimensional shape of the object based on a degree of deformation of the light pattern at the object.

13. The cooking appliance of claim 1, wherein the analysis facility calculates the three-dimensional shape of the object based on a degree of deformation of the light pattern at the object.

14. The cooking appliance of claim 1, wherein a light emitted by the light pattern projector and captured by the camera is visible light.

15. The cooking appliance of claim 1, wherein a light emitted by the light pattern projector and captured by the camera is infrared light.

16. The cooking appliance of claim 1, wherein the light pattern projector is configured to radiate a plurality of different light patterns into the cooking chamber.

17. The cooking appliance of claim 16, wherein the light pattern projector is configured to radiate the plurality of different light patterns into the cooking chamber in a predefined sequence.

18. The cooking appliance of claim 1, wherein the analysis facility is configured to recognize a plurality of types of food based on the light pattern analysis of the light pattern irradiated in the region by the light pattern projector during operation of the cooking appliance.

19. The cooking appliance of claim 1, wherein the analysis facility is configured to recognize at least one of a plurality of types of food supports or a plurality of types of equipment on a food support based on the light pattern analysis of the light pattern irradiated in the region by the light pattern projector during operation of the cooking appliance.

20. A cooking appliance, comprising:

a cooking chamber having a loading opening which is closable by a door;

a light pattern projector arranged in a fixed manner relative to the cooking chamber and configured to generate and radiate a light pattern into a region of the cooking chamber;

a camera for capturing images from the region being irradiated by the light pattern projector even when the cooking chamber is closed, said camera being arranged in a fixed manner relative to the cooking chamber;

an analysis facility coupled to the camera and configured to perform light pattern analysis of the light pattern irradiated into the region of the cooking chamber, the analysis facility configured to repeatedly calculate, based on the light pattern analysis of the light pattern, a three-dimensional shape of an object located in the region of the cooking chamber being irradiated by the light pattern projector during operation of the cooking appliance; and a muffle; and a food support in the muffle, the food support having predefined calibration markings, wherein the analysis facility is configured to use the predefined calibration markings to perform a calibration.

21. The cooking appliance of claim 20, wherein an optical axis of the light pattern projector and an optical axis of the camera extend at an angle of between 20° and 30° to each other.

22. The cooking appliance of claim 20, further comprising a ceiling, said light pattern projector and said camera being arranged behind the ceiling of the cooking chamber.

23. The cooking appliance of claim 20, wherein the light pattern projector includes at least one image point-type screen for shaping the light pattern.

24. The cooking appliance of claim 20, further comprising a screen configured to display at least one three-dimensional image of the object captured by the camera.

25. The cooking appliance of claim 20, wherein the analysis facility is configured to recognize a core temperature of the object.

26. The cooking appliance of claim 20, further comprising a control facility coupled to the analysis facility and configured to adjust operation of the cooking appliance based on at least one object parameter determined by the analysis facility.

27. The cooking appliance of claim 20, wherein the analysis facility calculates the three-dimensional shape of the object based on a degree of deformation of the light pattern at the object.

28. The cooking appliance of claim 20, wherein a light emitted by the light pattern projector and captured by the camera is visible light.

29. The cooking appliance of claim 20, wherein a light emitted by the light pattern projector and captured by the camera is infrared light.

30. The cooking appliance of claim 20, wherein the light pattern projector is configured to radiate a plurality of different light patterns into the cooking chamber.

31. The cooking appliance of claim 30, wherein the light pattern projector is configured to radiate the plurality of different light patterns into the cooking chamber in a predefined sequence.

32. The cooking appliance of claim 20, wherein the analysis facility is configured to recognize at least one of a plurality of types of food based on the light pattern analysis of the light pattern irradiated in the region by the light pattern projector during operation of the cooking appliance.

33. The cooking appliance of claim 20, wherein the analysis facility is configured to recognize at least one of a plurality of types of the food support or a plurality of types of equipment on the food support based on the light pattern analysis of the light pattern irradiated in the region by the light pattern projector during operation of the cooking appliance.

34. The cooking appliance of claim 20, wherein the muffle has predefined calibration markings delimiting the cooking chamber.

35. The cooking appliance of claim 20, wherein the analysis facility is configured to recognize an insertion level of the food support in the muffle based on the predefined calibration markings.

* * * * *